US009346607B2

(12) United States Patent
Madjar

(10) Patent No.: US 9,346,607 B2
(45) Date of Patent: May 24, 2016

(54) PORTABLE DRINKING VESSEL WITH BATTERY OPERATED, PUMP ASSISTED STRAW

(71) Applicant: Damjan Madjar, Kelowna (CA)

(72) Inventor: Damjan Madjar, Kelowna (CA)

( * ) Notice: Subject to any disclaimer, the term of this patent is extended or adjusted under 35 U.S.C. 154(b) by 0 days.

(21) Appl. No.: 14/293,942

(22) Filed: Jun. 2, 2014

(65) Prior Publication Data

US 2014/0353339 A1 Dec. 4, 2014

Related U.S. Application Data

(60) Provisional application No. 61/829,721, filed on May 31, 2013.

(51) Int. Cl.

| | |
|---|---|
| ***B65D 88/54*** | (2006.01) |
| ***B65D 83/00*** | (2006.01) |
| ***A47G 19/22*** | (2006.01) |

(52) U.S. Cl.

CPC ..... *B65D 83/00* (2013.01); *A47G 19/2272* (2013.01)

(58) Field of Classification Search

CPC . A47G 21/18; A47G 21/184; A47G 19/2266; A47G 19/2272; B65D 83/00; A61J 15/00; A61J 15/0011

USPC ..... 222/333, 334, 63, 209, 464.1; 224/148.2; 215/388, 389, 11.1–11.16; 220/703–710; 604/78, 79

See application file for complete search history.

(56) References Cited

U.S. PATENT DOCUMENTS

| | | | | |
|---|---|---|---|---|
| 3,227,158 | A | 1/1966 | Mattingly | |
| 4,269,329 | A * | 5/1981 | Keller | 222/333 |
| 4,494,668 | A * | 1/1985 | Lottick | 220/709 |
| 4,966,300 | A | 10/1990 | Coonradt | |
| 5,571,260 | A * | 11/1996 | Krug | 222/175 |
| 5,645,404 | A * | 7/1997 | Zelenak | 417/1 |
| 6,358,237 | B1 | 3/2002 | Paukovits et al. | |
| 6,375,459 | B1 | 4/2002 | Kamen et al. | |
| 8,284,050 | B1 | 10/2012 | Montgomery et al. | |
| 8,365,941 | B2 * | 2/2013 | Mayer | 220/259.3 |
| 8,460,234 | B1 * | 6/2013 | Duron-Smith | 604/77 |
| 8,852,144 | B2 * | 10/2014 | Al-Thallab | 604/77 |
| 2008/0308646 | A1 * | 12/2008 | Wu | A47G 19/2227 239/33 |
| 2010/0092309 | A1 | 4/2010 | Hockemeier | |

* cited by examiner

*Primary Examiner* — Lien Ngo
(74) *Attorney, Agent, or Firm* — Anthony C. Edwards

(57) ABSTRACT

A power assisted drinking vessel, using a battery powered liquid pump provides pressurized, low volume liquid from the drinking vessel to a user's mouth through a straw, without the user having to draw or provide suction on the straw. The liquid pump is activated by pressing a momentary on-off electrical power switch. The power assisted drinking cup is capable of pumping many commonly ingested liquids such as water, soft drinks, alcoholic drinks, dietary/meal supplements or juices of various viscosity and at various flow rates and pressures. The powered drinking cup will be a benefit to patients in hospital or after dental work has been performed and will have appeal for many novelty use and sporting applications.

10 Claims, 6 Drawing Sheets

Example Performance of Single Phase Brushless DC pump

Measured Power Consumption (All measurements taken with a 30cm head of pumped water)

| Volts | Amps | Watts | Motor Resistance Ohms | Pump Vol cc/min | Pump Capacity cc/watt | Pump Duration Hrs for Whr of AA battery capacity 2.5 | 3 | Pump Duration Hrs for Whr of AAA battery capacity 1.0 | 1.2 |
|---|---|---|---|---|---|---|---|---|---|
| 2.5 | 0.18 | 0.45 | 13.89 | 480 | 1067 | 5.56 | 6.67 | 2.22 | 2.67 |
| 3 | 0.23 | 0.69 | 13.04 | 720 | 1043 | 3.62 | 4.35 | 1.45 | 1.74 |
| 3.5 | 0.26 | 0.91 | 13.46 | 890 | 978 | 2.75 | 3.30 | 1.10 | 1.32 |
| 4 | 0.31 | 1.24 | 12.90 | 1,080 | 871 | 2.02 | 2.42 | 0.81 | 0.97 |
| 4.5 | 0.35 | 1.575 | 12.86 | 1,200 | 762 | 1.59 | 1.90 | 0.63 | 0.76 |

Note: <2.5V Pump does not operate

Good quality AA has 2.0 to 2.5 Watthrs of power with a continous current draw of 0.18A Good quality AAA has 1.0 to 1.2 Watthrs of power with a continous current draw of 0.18A

Figure 6

PORTABLE DRINKING VESSEL WITH BATTERY OPERATED, PUMP ASSISTED STRAW

CROSS REFERENCE TO RELATED APPLICATION

This application claims priority from U.S. Provisional Patent Application No. 61/829,721 filed May 31, 2013 entitled Portable Drinking Vessel with Battery Operated, Pump Assisted Drinking Straw.

FIELD OF THE INVENTION

This invention relates to the field of drinking vessels having straws, and in particular to a portable drinking vessel having a battery operated, pump-assisted drinking straw.

BACKGROUND OF THE INVENTION

One application for a power assisted drinking vessel is in the health industry. In dentistry after a tooth is extracted, a patient can develop a so-called "dry socket" at the site of the extracted tooth if they drink liquids using a straw, due to the vacuum created in the mouth when sucking liquids through the straw. In addition drinking from a cup may be initially difficult after dental surgery due to the numb lips of the patient making it difficult to sense and seal against the edge of a cup and ingest the liquid contents. Placing the power assisted cup drinking straw into the patient's mouth negates both of these problems and allows the patient to ingest the required liquids.

When surgery on a patient's mouth or jaw is performed, it often is required that the patients jaw is wired shut for extended periods of time to enable a proper healing process. This requires that is food is injected into the patient's mouth using a syringe. The power assisted drinking cup described herein eliminates the discomfort, displeasing aesthetics and tediousness of syringe feeding and similar feeding processes by assisting the patient with power assisted delivery of liquids from a handheld cup. The power assisted cup would be utilized within hospitals in post-surgery circumstances when assistance is needed with hydration or intake of fluidized medication or vitamins. Those that are unable to drink by using a straw due to the deterioration of facial or other muscles, such as after a stroke, would also benefit through the use of powered liquid delivery. Within the health industry, occupational therapists may use the power assisted drinking cup for rehabilitation purposes when individuals lose some motor ability to intake liquids themselves. The elderly may struggle with the use of a conventional cup with or without a straw. The power assisted drinking cup described herein aids in the intake of liquid substances for the elderly.

Other applications of the power assisted drinking cup described herein may include novelty uses ranging from backyard entertainment, parties, night clubs or any location where cold drinks may be served or consumed. It may also find use in sports by providing athletes with a convenient and easy way to hydrate them without the need to take off for example a hockey or football mask to have a drink. A conventional plastic squeezable water bottle is not as practical for when squeezed the volume and force of liquid expelled is unpredictable and varies depending on the force applied to the bottle or the volume of liquid within the bottle. The power assisted drinking cup provides an adjustable but consistent, steady discharge of liquid from an on-board fluid reservoir in the cup. Due to the novelty appeal of the cup it may be used for promotional activities to targeted recreational markets by using the cup as a platform for corporate logos and secondary product promotion.

In the prior art the applicant is aware of the following prior art:

U.S. Pat. No. 4,966,300, Coonradt, October 1990 "Insulated Drinking container", describes an insulated drinking container having an insulated cup and an insulated lid which is threadably engagable over the open upper end of the cup. The lid includes an integrally formed grasping handle and an elongated centrally disposed, downwardly extending straw housing.

The straw housing includes a stationary straw which extends downward to the bottom of the cup and a removable straw slidably translatable up and down in the stationary housing adjacent the stationary straw between a downward stored position fully within the straw housing and an upward sipping position extended above the lid. Only when in its sipping position is the removable straw, having an aperture formed through its wall for this purpose, in liquid communication with the stationary straw so that liquid in the container may be removed. Pressurizing and suction features which automatically urge the removable straw upward to its sipping position and downward to its stored position are also disclosed. Electrically powered features such as a pump, switch, or batteries are not disclosed.

U.S. Pat. No. 8,284,050, Montgomery, "Drinking vessel with integral locating device". A drinking vessel is described, which has an attached wireless electronic locator system comprised of a detachable drinking vessel base housing having an internal receiver and a speaker powered by a rechargeable battery when the drinking vessel is placed on a contact surface portion of a charging base. The drinking vessel base and internal electronics are separate and removable which allows the drinking vessel to be washed and/or sterilized. A button on the recharging base activates a transmitter which signals the receiver on the drinking vessel to activate an audible alarm on the drinking vessel base. An illuminated lamp to further aid in finding the drinking vessel when misplaced is also provided. The charging base and transmitter receive electrical power from a standard wall outlet. The battery is used to flash integrated lights and audio alerts to provide a means to locate the cup.

US Patent Application US2010/0092309 A1 "Drinking straw pump apparatus and method for using" April 2010. A disposable drinking straw is described that contains within it a manual pump and integrated valves enabling the user to manually pump liquid into the user's mouth.

U.S. Pat. No. 6,358,237 B1, Paukovits, March 2002, "Methods and apparatus for delivering liquid to a patient". A system using a standalone pump is described, wherein the system is controlled by micro-processors, sensors and various command instruments to pump liquid using a peristaltic pump into a patient's mouth.

SUMMARY OF THE INVENTION

The power assisted drinking cup described herein facilitates the pumping of conventional drinks such as water, flavored drinks, nutritional drinks, juices, sodas, and including frozen drinks such as slushies', frappes, milk shakes and blended drinks. Food slurries of an appropriate consistency such as blended soups and food may also be dispensed.

The general physical configuration of the power assisted drinking cup or vessel according to the present specification is a drinking cup with a base containing a battery power source;

a low volume, low pressure liquid pump; an external momentary on-off electrical power switch; a straw; and an optional pump speed selector control.

Three configurations are provided, although, without intending to be limiting, other configurations may be employed as would be appreciated by one skilled in the art.

The first configuration is a completely integrated cup with a non-separable pump unit and batteries. The cup can be designed with a watertight construction including a watertight battery cover that would allow the cup to be fully submersed for cleaning. The cup may also be designed to have a non-waterproof battery cover and must be carefully washed by hand so as not to submerse or get the internal electrical components wet.

The second cup configuration is for the lower pump housing assembly containing the pump and power unit to be separable from the drinking cup fluid container. The cup container has an integrated base that allows attachment to the drinking cup base and has orifices in the bottom connection to the pump outlet and for liquid to enter the pump inlet. The pump, battery and switch assembly is quickly releasable from the cup and allows the cup to be submerged and washed by hand or placed in a dishwasher. The pump housing base may be designed in both watertight and non-watertight configurations.

A third configuration provides for a cup that is a principally a cylinder open at both ends that is reversible, end-for-end, and which is quickly releasable from the pump and battery compartment base to allow the cup container to be submerged and washed by hand or placed in a dishwasher. The pump housing base may be designed in both watertight and non-watertight configurations.

All configurations include a lid and a straw.

In summary, the pump-assisted drinking vessel according to one aspect of the present invention may be characterized as including a hollow container having opposite first and second ends, wherein the first end has an opening into the container. A lid is removably mountable onto the first end and is configured to seal the opening when so mounted. The lid has a straw aperture. A base is coupled, either fixedly or removably to the second end. A pump and battery is mounted in the base.

The base has a fluid inlet and a fluid outlet. The fluid inlet and outlet are disposed, that is, positioned so as to operably face into the container when the base is coupled to the second end of the container. The fluid inlet and fluid outlet cooperate with the pump so that fluid pumped into the base from the inlet is pumped under pressure out from the outlet into and through the straw. The straw has a lower end configured to mount to the fluid outlet, and an opposite upper end mountable journalled through the straw aperture in the lid.

The battery cooperates with, so as to power the pump. A momentary switch cooperates with the pump so as to bias the pump between a pump-power-on and a pump-power-off binary condition according to a corresponding touch pressure applied by a user to the momentary switch.

Advantageously the straw may include an upset on the upper end of the straw. The upset is located on or near the upper end of the straw so as to engage around the straw aperture in the lid and against the underside of the lid when the lid is mounted on the first end of the container. Thus, with the lower end of the straw mounted to the fluid outlet, and the upper end of the straw protruding through the straw aperture, the lid engages in compression down against the upset on the straw so as to compress the lower end of the straw in sealed engagement against the fluid outlet.

In one embodiment, not intended to be limiting, the outlet includes a nipple fitting and the lower end of the straw mates onto the nipple fitting.

In embodiments of the invention the upset may be a flange extending at least partly around the upper end of the straw. The flange may for example be an annular ridge extending as a substantially continuous ring around the upper end of the straw.

Advantageously a pump power selector may be included. The pump power selector may be configured to lower a pump speed of the pump as power levels in the battery lower from usage of the pump. The pump power selector may also adjust the pump speed according to a viscosity of a fluid contained in the container.

In one embodiment the container is a substantially cylindrical cup having a corresponding round open end at the first end, and a correspondingly round base end at the second end of the container. The lid is releasably mountable to the open end. The base may be releasably mountable to the second end, or may be permanently mounted on the second end. In one embodiment the first and second ends of the container are reversible. The base may be water-tight in which case the battery may be inductively charged by an inductive coupling between a coil in the base and a coil in a charging stand.

BRIEF DESCRIPTION OF THE DRAWINGS

FIG. 6: Table of performance of a single phase DC pump.

DETAILED DESCRIPTION OF EMBODIMENTS OF THE INVENTION

Figure 1:
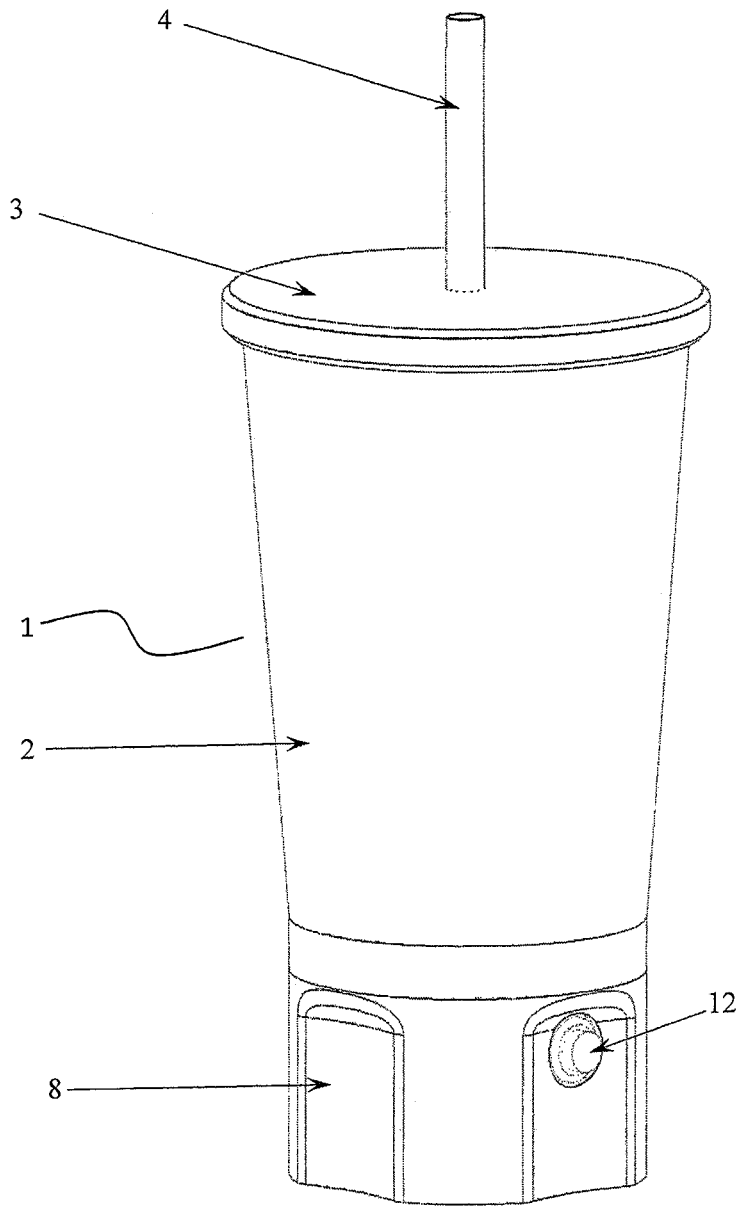
FIG. 1: Complete cup assembly.

In the following description like reference numerals denote corresponding parts in each view.

Cup

The power assisted drinking cup container may be made from multiple materials both rigid such as spun metals and hard plastics or be flexible when constructed using soft plastics. The cup may include conventional or unconventional drinking vessel shapes not limited to those illustrated in this specification. Some common shapes include cylindrical, truncated cone, spherical; simple or complex curve forms or other shape that lends itself to mass production manufacturing technologies such as but not limited to injection molding, rotational molding, blow molding, vacuum forming and metal forming technologies. The cup may be single or double walled.

Double walled cup variants provide insulation to hot or cold liquid contents of the cup. The void between the vessel inner and outer walls may be air filled, or the void may be filled with insulation such as micro-particles, gels or fibrous sheet, or can be placed under a vacuum. Exterior variations in the cup design include the container having a smooth or textured exterior, cosmetic or functional grip rings, adornments or lugs, and having a handle like a mug. The cup can be transparent, translucent or opaque, and can be printed in multiple colors with custom logos and/or designs printed either on the outside of the cup if single walled, or on inside surface of the outside wall if it is a double walled cup. Multiple plastic or polymer types, may be used including individual polymers such as but not limited too Polystyrene, Acrylic, Polycarbonate or copolymers such as Acrylonitrile Styrene, ABS; or metals including stainless steel and aluminum.

If the cup container is separable from the pump base, the bottom of the cup will incorporate mating attachment features such as full or partial threads, part turn attachment mechanisms such as ⅛ turn lugs, ears or equivalent that enable the cup to quick attach to the base. The top of the cup may be equipped with similar attachment features to provide a means of securely attaching the lid. Both ends of the container may be compatible with both the lid and the base so that the container is reversible end-for-end.

The drinking cup may be provided in multiple configurations including fully integrated where the cup container is permanently attached to the pump base; the cup container may be separable from the pump base and have a partial bottom with orifices to allow transfer of liquid from the cup container through the pump and out of the straw, or it may be an open ended structure such as a cylinder that can only hold liquid when attached to the base.

Straw

The straw protrudes out of the cup, through the lid, and is replaceable. The straw may be either straight, bent or have flex assisting corrugations or other means for flexing along part of its upper length. The straw is attached to the pump outlet by screwing it onto a threaded boss or by using frictional fits such as barbs, tube flares, tapers of both external and internal design varieties. The upper part of the straw may be smooth or have an upset such as a molded ridge to engage the underside of the lid. Advantageously the straw ridge is positioned on the straw such that the distance of the ridge along the straw places a slight crush force on the ridge when the lid is tightened onto the container, so as to slightly compress the straw down onto its fitting on the pump. This slight crushing or compressive force allows the straw and lid to develop and maintain a compressive seal that reduces the opportunity of spillage or leakage from around the lid aperture and the straw. The ridge prevents the straw from sliding upwardly out of the lid aperture, and holds the straw onto its fitting on the pump.

Lid

The lid for drinking cup may be transparent, translucent or opaque and be in any of multiple colors. It may screw or snap onto the top of the cup container and may incorporate a leak proof elastomer seal such as an o-ring or flat ring gasket to seal the lid against the top of the cup container or it may have a non-elastomer mechanical seal such as mating flanges or flares. The lid may provide a mating surface to mate against the straw ridge so as to provide a seal against the lid when placed under a small compressive force developed when the lid is tightened onto the cup container. There may also be a captive elastomer ring or gasket around the orifice of the lid through which the straw protrudes, to reduce the potential of leaks around the straw lid interface. The lid may have ridges on the outside edge for enhanced grip. The lid may incorporate attachment features such as full or partial threads, part turn attachment mechanisms such as ⅛ turn lugs, ears or equivalent that enable the lid to quick attach to the cup container. The lid can be either of a nominally flat design or have a raised profile of any geometric shape, for example a dome shape.

Pump Housing

The pump housing or the external base of the cup is the outer case of the pump assembly which includes the battery power source, pump, momentary switch, wiring harness and optional speed control. When the pump housing is separable from the cup container, the housing also includes quick attach features and elastomer seals to seal the pump housing against the cup container. The pump housing can be made from machined or cast metals such as aluminum or pot metals such as zinc alloys or injection molded plastics such as those used for the cup. The pump housing material maybe transparent, translucent or opaque.

The separable pump housing includes a quick release attachment feature to allow it to be removed from the cup container. The attachment method maybe full or partial threads, mating lugs, ears or equivalent that require only a part, full or multiple turns for engagement. Other similar features that allow the parts to be separated could be snap or push fit components. Regardless of the engagement method used, it must supply sufficient compression to the o-ring seals or gaskets between the cup and the pump inlet and outlet that no liquid leaks at the pump housing cup seal interface. The pump housing may be of many shapes in section including cylindrical, oval and rectangular and have any of many features that allow it be gripped such as ridges, flutes, rubber grips etc. A removable battery cover on the bottom side of the pump housing allows the battery power source to be replaced as required. An option for fully sealed pump housing either separable or integrated with the cup, would be the provision of inductively charged internal batteries. A secondary inductive coil, rectification and voltage conditioning and battery charging circuit placed in the bottom of the pump housing is able to receive electrical power inductively through the plastic base enclosure that is sealed to make it waterproof. The cup base is placed onto a charging pad or cup holder or other charging stand that has a primary coil and charging circuit embedded within it. The two coils inductively coupled to transfer power to charge the battery.

The pump housing may also include LED lighting which may illuminate the pump housing and or cup with a variety of different colored light, in a steady state, flashing or rhythmic illumination. The LED lights may be connected to a microprocessor and sensors that are sensitive to and respond to vibration or acoustic signals such as background music, that in turn changes the sequencing, flash rate or colors of the embedded LED's.

The pump housing may be a snap together assembly for manufacturing ease or can be permanently assembled using adhesives, threaded fasteners, welding or molding to make it completely watertight.

Battery Power Source

The battery or batteries that provide electrical power to the pump are housed within the pump housing. The pump can be powered over a range of battery voltages from 1.5 VDC to 12 VDC, with a typical operating voltage of 3.0 to 4.5 VDC. Any commercial battery format can be used such as AAA, AA, C,D, 9V, Li 18650 or A123 of any amp-hour capacity. Both primary (non-rechargeable) and secondary (rechargeable) batteries of any chemistry can be used. Primary battery chemistries can be alkaline or lithium and secondary battery chemistry can be NiCD, NiMH, Lithium ion and Lithium polymer. Rechargeable batteries may be removed from the pump housing to be recharged or can be charged within the housing by providing a DC power source recharge capability to the pump housing. As previously discussed another charging alternative is the wireless inductive charging of the batteries.

Switch Button

The purpose of the pump switch is to momentarily turn the pump on from its 'off' state to pump liquid from the straw into the user's mouth. A non-momentary switch that stays on continuously could be used however, this is not preferred as it might allow the contents of the cup to spill, allow the pump to run dry and would be difficult to regulate the volume of liquid to be drunk by the user. The switch can be placed in different locations depending on cup configuration. If a drinking vessel is of a non-separable base design, the switch can be placed anywhere on the pump housing or cup. If the cup is of a separable base design, the switch would typically be placed on the base or pump housing. The switch may be oriented in any position around the outside of the base so as to provide ergonomic ease of use, and maybe recessed into the pump housing to prevent accidental activation. Its general appearance may be made to conform to the ergonomics of the drinking vessel design. The switch may be of many different touch designs that may be either a momentary slide or push button including larger mechanical spring loaded contact, dome switch, membrane switch, magnetic reed switch, hall-effect sensor actuator or a heat touch sensor switch, capacitive touch screen sensor, among other types available. The switch if it includes a button may have an elastomer cover over the button that is functional for water resistance, for tactile feel or for aesthetics. The switch may have sufficient current carrying capacity to switch the required pump operating current directly or in the case of a membrane switch, which cannot switch higher current loads, a transistor switch circuit would be employed to provide power from the battery to the pump.

An optional function for the pump power circuit is to provide a pump power selector switch that may be used to change the rate or volume of liquid pumped. Any number of discrete settings can be used, for example the user can select low, medium or high pump rates or it may be continuously variable. The pump power selector can be used to control or regulate flow rate when battery power is high and then be adjusted either manually or automatically as would be known to one skilled in the art to compensate as battery power runs down or when pumping high viscosity fluids. The switching circuit would be housed within the pump housing adjacent to the batteries and power switch. The switch circuit may be of many architectures such as but not limited to a simple mechanically selector using a multi-pole slide or rotary switch and resistors, be continuously variable such as by using a potentiometer, a voltage regulator sub-circuit with a range of voltage outputs to the pump or an IC controlled pulse width modulated circuit that regulates power to the pump.

Pump

The pump should be of a food grade quality and materials, and is located within the base of the pump housing. The inlet of the pump draws liquid from inside the cup container or vessel and expels it via the pump outlet at appropriate low volumes and pressures through the straw for drinking consumption.

Miniature pumps of all types and configurations can be utilized, such as but not limited to piston, centrifugal, gear, diaphragm, vane or lobe with the pump and motor contained within the pump housing. Alternate configurations include magnetic impeller pumps, where the motor is contained within the pump housing and the impeller is located within the cup and is driven through the plastic layers by magnetic coupling. Motor types such as cylindrical or pancake armature motors may be used. The pancake motor (like a hard disk drive motor) offers the advantage of providing greater amounts of torque over a cylindrical motor to pump higher viscosity liquids, while being in a low height package format. The motors may be of a brushed direct current (DC) or brushless DC single phase in-runner or out-runner core configuration. A further option is brushless alternating current (AC) three phase in-runner or out-runner core configuration motors in which case the AC power is provided to the motor by an electronic DC-AC drive circuit that also provides variable speed control.

An orifice in the upper surface of the pump housing, allows drink liquid to be gravity fed or be drawn by a self-priming pump into the pump inlet. When the momentary power switch is actuated to its ON position, the pump is energized with power from the battery and the drink liquid is pumped out of pump outlet through the straw into the user's mouth. An optional speed control can used to regulate the flow of liquid pumped through the straw.

FIG. 1 shows drinking cup 1, including the drinking straw 4, the cup lid 3, the cup container 2, the pump assembly base 8 and the momentary on-off power switch 12 to activate the pump.

Figures 2A, 2B:
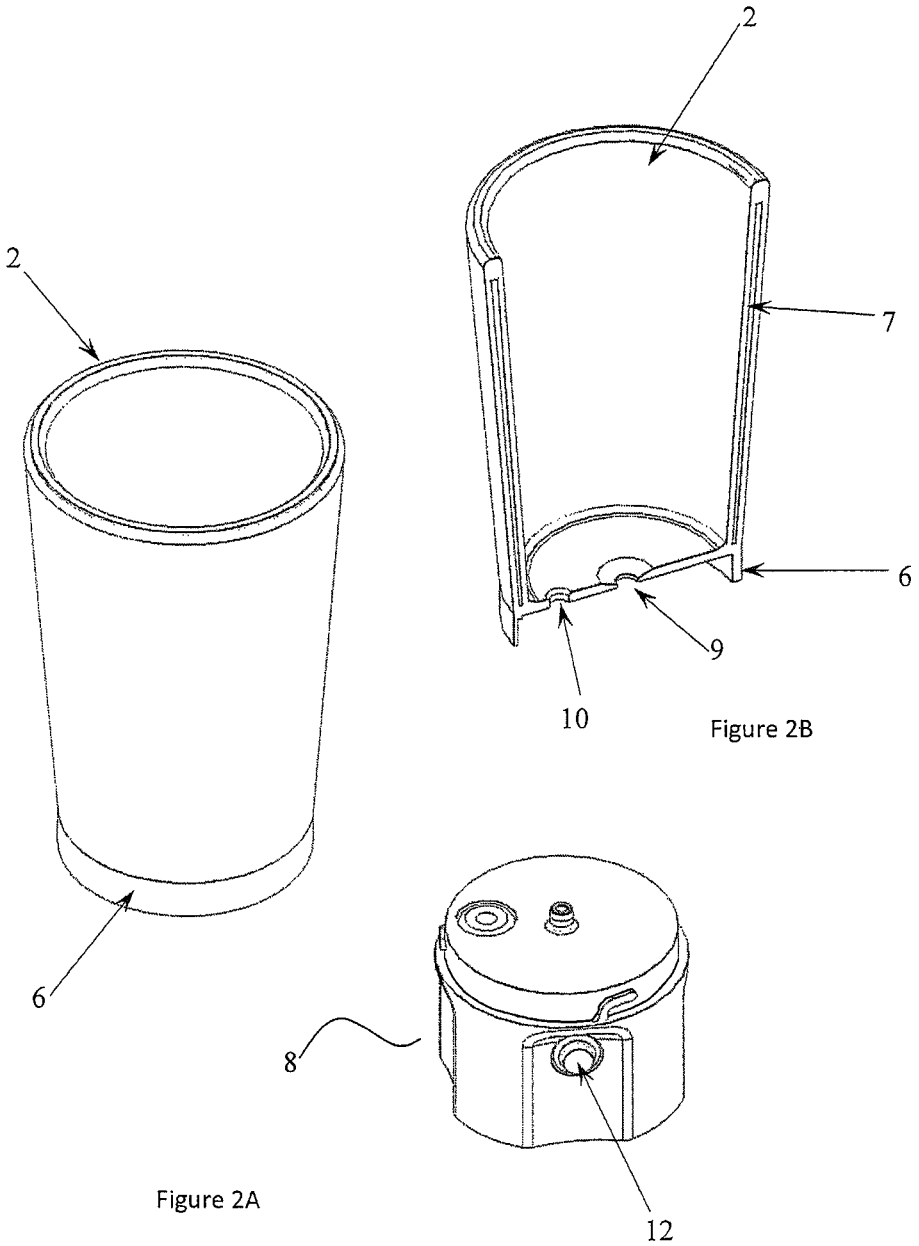
FIG. 2*a*: Drinking cup separated from pump enclosure.
FIG. 2*b*: Cross-section of cup with integrated base and inlet outlet orifices.

FIG. 2A shows cup container 2 having an integrated base 6 that couples the cup container to the pump base 8. FIG. 2B shows a cross section of the cup container 2 constructed as a sealed insulated double walled vessel for the liquid contained by the cup. Insulation is provided to the cup by double wall internal void 7. The cup container has an integrated base 6. The integrated base 6 has a central orifice 9 through which drinking straw 4 may be attached to the outlet of the pump, and a pump inlet orifice 10 through which liquid contained within the cup container 2 may be drawn into the pump inlet.

Figure 3:
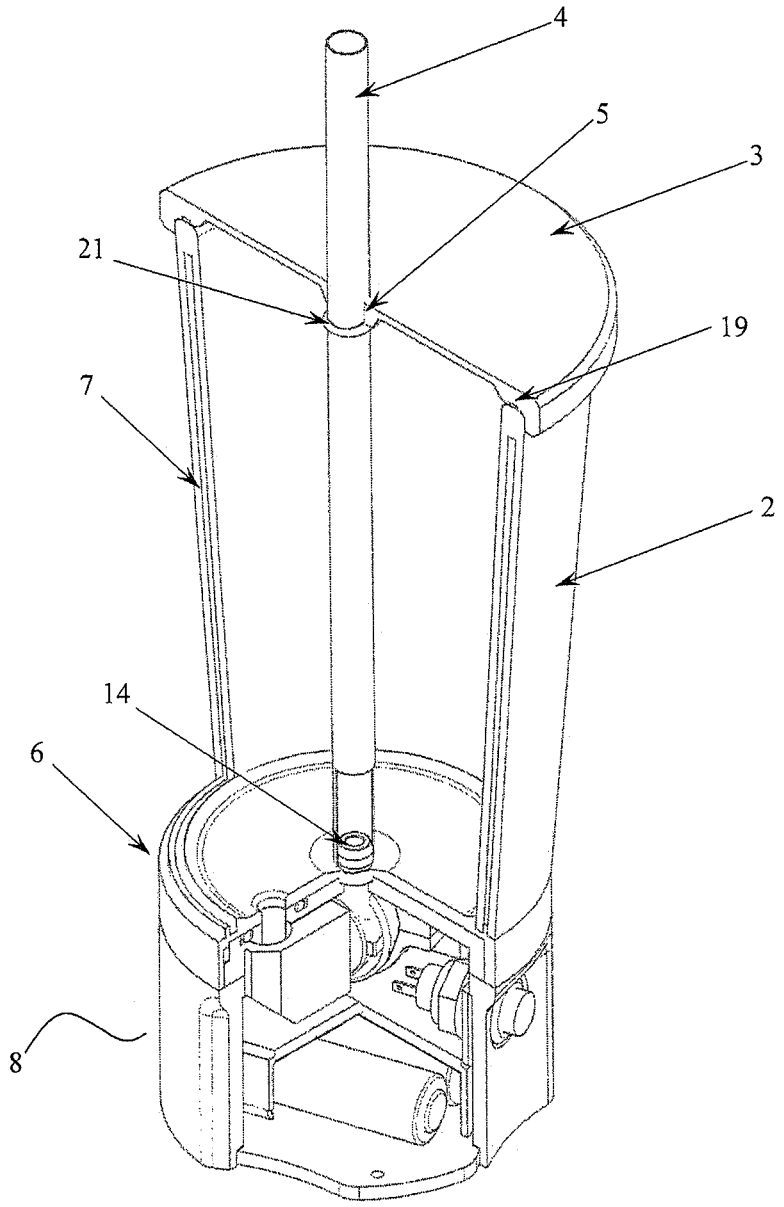
FIG. 3: Section view of cup and pump housing assembly.

FIG. 3 provides an internal view of the drinking cup base 8. Cup lid 3 has an orifice 5 that allows the drinking straw 4 to pass through the lid 3. The drinking straw 4 is shown with a straw ridge 21, which is compressed against a mating surface on the lid 3 when the lid 3 is on the cup container 2. The outer diameter of the lid has seal 19. The drinking straw 4 attaches to the pump outlet fitting 14.

Figure 4:
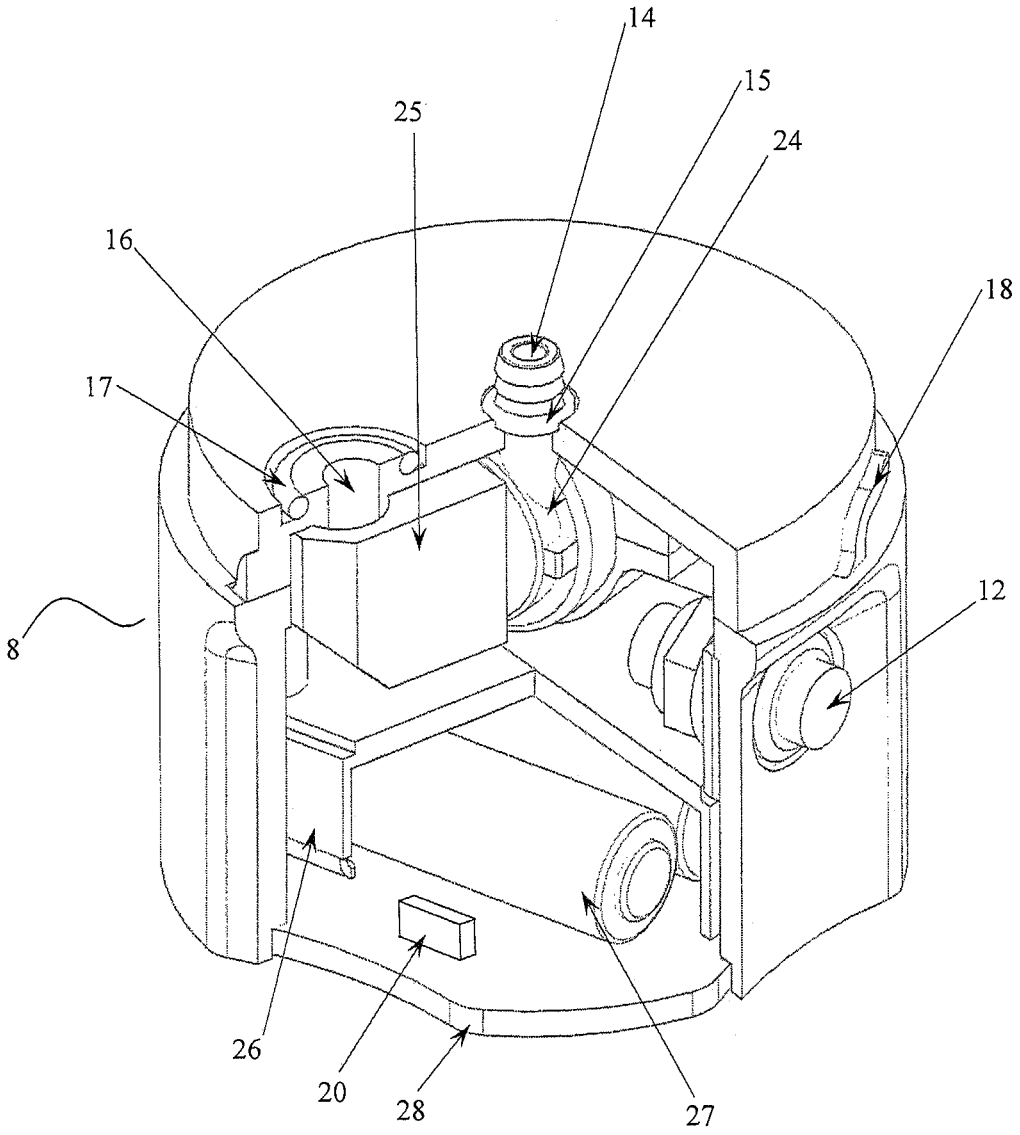
FIG. 4: Section view of pump housing assembly.

FIG. 4 is the section view of the drinking cup base 8 from FIG. 3. Base 8 provides a compartment for the pump and battery. Mechanical locks 18 secure the container 2 onto base 8 so as to align orifice 10 with the pump inlet 16. An O-ring or gasket 15 provides a seal between the base of cup container 2 and pump outlet 14. O-ring or gasket 17 provides a seal between the base of cup container 2 and the pump inlet 16. The pump 24 is provided with electrical power by batteries 27 held in a battery holder 26. Electric power from the batteries 27 is provided to the pump 24 via momentary on-off power switch 12. The speed of the pump motor may be determined by a multi-position switch 20 that can be positioned to select a desired pump speed or pumped liquid volume rate. Elbow 25 connects the pump inlet 16 to pump 24.

Figure 5:
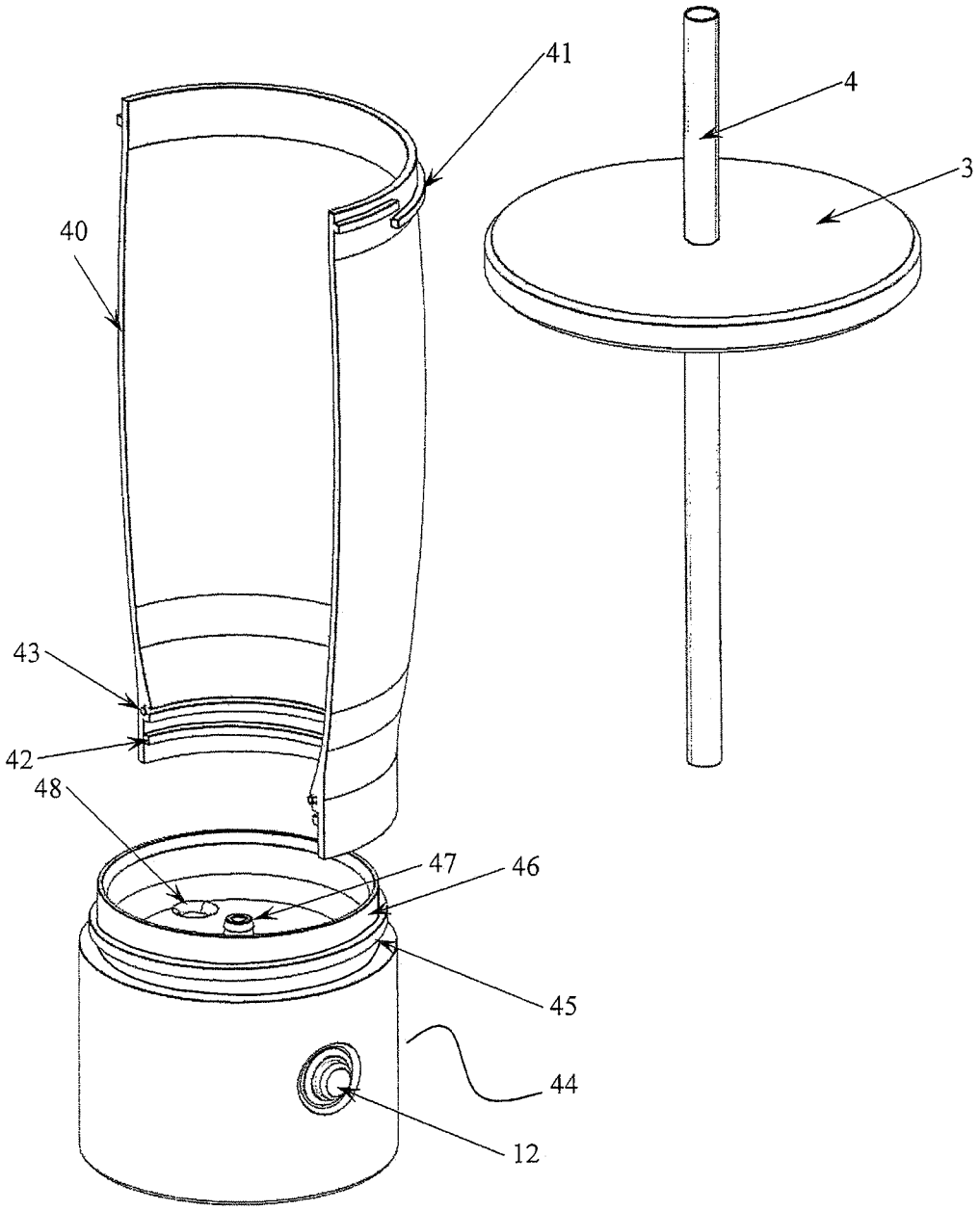
FIG. 5: View of separable cup as an open ended cylinder with attachment thread and seal on pump housing assembly.

In FIG. 5, an open-ended cylinder provides container 40 when mounted cup base 44. Base 44 has pump outlet 47, and the pump inlet orifice 48, and pump switch 12. Thread 45 on base 44 mates with thread 42 on container 40. O-ring 43 provides a seal between container 40 and base 44 against flange 46. Lid 3 may mount onto container 40 using thread 41.

The following pump operating characteristics have been found to work in a prototype power assisted drinking vessel.

Working voltage range: 3.5 VDC-12 VDC (for single phase DC pump)

Max-static water head: 0.5-2M±10% (water)

Max-static flow rate: 0.7-2 L/min±10% (water)

Working environment temperature <60° C.

Liquid PH value: PH4-11

Max noise: Continuous operation under normal working condition. (Measured at 1 meter distance between the pump body and test equipment)

<32 dB±10%

Max working temperature Liquid temperature ≤100° C.

Drink Liquid Viscosity Range

Established range from Water to Milkshake Water:

1.0 cP (centi Poise) at 20° C.

0.28 cP at 100° C.

Milkshake/Frappe: 200 cP
Liquid Volume Pumping Rate
Lowest volume pumped: 5 cc/min
Highest volume pumped: 2000 cc As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pump-assisted drinking vessel comprising:

a hollow container having opposite first and second ends, said first end having an opening into said container, a lid removably mountable onto said first end and configured to seal said opening when so mounted, wherein said lid has a straw aperture therein, a base coupled to said second end, a pump mounted in said base, said base having a fluid inlet and a fluid outlet, wherein said inlet and outlet are disposed into said container when said base is said coupled to said second end, wherein said fluid inlet and said fluid outlet cooperate with said pump so that fluid pumped into said base from said inlet is forced under pressure out from said outlet into said container, a drinking straw having a lower end configured to mount onto said fluid outlet, and an opposite upper end mountable journalled through said straw aperture in said lid, a battery in said base and cooperating with, so as to power, said pump, a momentary switch cooperating with said pump so as to bias said pump between a pump-power on and a pump-power off binary conditions according to a corresponding touch pressure applied by a user to said switch, wherein said pump includes a pump power selector which adjusts a pump speed according to a viscosity of a fluid contained in said container.

2. The vessel of claim 1 wherein said straw includes an upset on said upper end of said straw, wherein said upset is located on said upper end so as to engage around said straw aperture against an underside of said lid when said lid is mounted on said first end of said container, whereby, with said lower end of said straw said mounted to said outlet, and said upper end of said straw protruding through said straw aperture, said lid engages in compression down against said upset so as to compress said lower end of said straw in sealed engagement against said fluid outlet.

3. The vessel of claim 2 wherein said outlet includes a nipple fitting and said lower end of said straw mates onto said nipple fitting.

4. The vessel of claim 3 wherein said upset is a flange extending at least partly around said upper end of said straw.

5. The vessel of claim 4 wherein said flange is an annular ridge extending as a substantially continuous ring around said upper end of said straw.

6. The vessel of claim 1 wherein said pump includes said pump power selector configured to lower a pump speed of said pump as power levels in said battery lower from usage of said pump.

7. The vessel of claim 1 wherein said container is a substantially cylindrical cup having a corresponding round open end at said first end, and a correspondingly round base end at said second end, and wherein said lid is releasably mountable to said open end and said base is releasably mountable to said second end.

8. The vessel of claim 7 wherein said base is permanently mounted on said second end.

9. The vessel of claim 1 wherein said base is water-tight and said battery is inductively charged by an inductive coupling between a coil in said base and a coil in a charging stand.

10. The vessel of claim 7 wherein said first and second ends are reversible so that first end is mountable to said base and said second end is mountable to said lid.

* * * * *